US010475368B2

(12) United States Patent
Park et al.

(10) Patent No.: US 10,475,368 B2
(45) Date of Patent: Nov. 12, 2019

(54) DISPLAY DEVICE AND METHOD FOR CONTROLLING THE SAME

(71) Applicant: Samsung Electronics Co., Ltd., Suwon-si, Gyeonggi-do (KR)

(72) Inventors: Ji-yong Park, Suwon-si (KR); Young-hoon Cho, Suwon-si (KR); Sang-kyun Im, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 147 days.

(21) Appl. No.: 15/299,624

(22) Filed: Oct. 21, 2016

(65) Prior Publication Data

US 2017/0116907 A1 Apr. 27, 2017

(30) Foreign Application Priority Data

Oct. 21, 2015 (KR) ..... 10-2015-0146414

(51) Int. Cl.
*G09G 3/20* (2006.01)
*G09G 3/30* (2006.01)

(52) U.S. Cl.
CPC ..... *G09G 3/2044* (2013.01); *G09G 3/30* (2013.01); *G09G 2320/0233* (2013.01); *G09G 2320/0261* (2013.01); *G09G 2360/144* (2013.01)

(58) Field of Classification Search
CPC ..... G09G 3/2044; G09G 3/2051; G09G 3/30; G09G 3/3208; G09G 3/3426; G09G 2320/0233; G09G 2320/0238; G09G 2320/0261; G09G 2360/144; G09G 2360/16
See application file for complete search history.

(56) References Cited

U.S. PATENT DOCUMENTS

2005/0110714 A1* 5/2005 Lee ..... G09G 3/2055 345/63
2006/0007068 A1* 1/2006 Suzuki ..... G09G 3/2029 345/63
2007/0109313 A1* 5/2007 Jo ..... H04N 5/20 345/589
2008/0094426 A1* 4/2008 Kimpe ..... G09G 3/20 345/691
2010/0053185 A1* 3/2010 Hwang ..... G09G 3/2055 345/556
2014/0176518 A1 6/2014 Min et al.
2016/0071485 A1* 3/2016 Tripathi ..... G09G 5/10 345/589

FOREIGN PATENT DOCUMENTS

EP 2525344 A1 * 11/2012 ..... G09G 3/3607
JP 2004-29265 1/2004
JP 2005-27016 1/2005
KR 2002-0021566 3/2002
KR 10-2014-0083741 7/2014
KR 10-2015-0043741 4/2015

* cited by examiner

*Primary Examiner* — Stacy Khoo
(74) *Attorney, Agent, or Firm* — Staas & Halsey LLP

(57) ABSTRACT

A display device is provided, which includes a display, a ditherer configured to perform dithering of video data displayed on the display, an illumination sensor configured to sense illumination around the display device, and a processor configured to control driving of the ditherer on the basis of a grayscale level of the video data if or when the sensed illumination is lower than a predetermined value.

20 Claims, 5 Drawing Sheets

FIG. 3

| | |
|---|---|
| 0 | 1 |
| 1 | 0 |

(a)

| | |
|---|---|
| 0 | 2 |
| 1 | 3 |

(b)

| | |
|---|---|
| 1 | 2 |
| 2 | 3 |

(c)

| | |
|---|---|
| 0 | 0 |
| 0 | 0 |

(d)

DISPLAY DEVICE AND METHOD FOR CONTROLLING THE SAME

CROSS-REFERENCE TO RELATED APPLICATIONS

This application claims priority from Korean Patent Application No. 10-2015-0146414 filed on Oct. 21, 2015 in the Korean Intellectual Property Office, the disclosure of which is incorporated herein by reference in its entirety.

BACKGROUND

1. Field

The present disclosure relates to a display device and a method for controlling the same.

2. Description of the Related Art

The human eye has a feature that it is more sensitive to a luminance difference in a dark region than that in a bright region. Such a feature is well known even as Weber's law. Further, such a feature is well revealed even in the luminance characteristic of an image that is displayed on a display device.

In particular, the non-linear luminance characteristic due to a digital input of a display device causes a problem in that the number of grayscale or grayscale values being expressed in a dark region of an image becomes insufficient and thus grayscales are not smoothly represented. Reduction of the number of grayscales in such a low-grayscale region causes minuteness of a dark image not to be expressed and causes false contours to occur.

An existing representative method for increasing the number of grayscales being expressed may be a dithering method. The dithering is a technology to express insufficient color information as a density combination of similar colors in the case where an image that is composed of upper bits is output through a device that supports lower bits in addition to the upper bits.

In particular, since the display device uses an LED module that is a self-luminous element, the luminance is high, and a refresh rate is also relatively high. However, the refresh rate differs depending on the grayscales, and in low grayscales, the refresh rate becomes relatively lower due to the structure of the display device. Accordingly, in the case of a high-luminance and high scan rate display device, the luminance difference between respective levels of the low grayscale value becomes larger, and in the case of performing dithering, the luminance difference between surrounding pixels becomes greater in the low-grayscale image to cause noise to occur. A viewer may feel such noise is greater in a dark place than in a bright place.

Accordingly, there has been a need for techniques to solve the problem of image quality deterioration that a viewer feels or sees from a low-grayscale image on a display device.

SUMMARY

Additional aspects and/or advantages will be set forth in part in the description which follows and, in part, will be apparent from the description, or may be learned by practice thereof.

Exemplary embodiments of the present disclosure overcome the above disadvantages and other disadvantages not described above, and provide a display device and a method for controlling the same, which can minimize noise that occurs on a low-grayscale image.

According to an aspect of the present disclosure, a display device includes a display; a ditherer configured to perform dithering of video data that is displayed on the display; an illumination sensor configured to sense illumination around the display device; and a processor configured to control driving of the ditherer on the basis of a grayscale level of the video data if the sensed illumination is lower than a predetermined value.

If or when there exists a first region in which the grayscale level of the video data is lower than a predetermined value, the processor may turn off driving of a dithering block that is used when the ditherer performs dithering of the first region.

If an average grayscale level of the video data is lower than a predetermined value, the processor may turn off the driving of the ditherer.

If there exists a first region in which the grayscale level of the video data is lower than a predetermined value, the processor may control the driving of the ditherer to lower a dithering value of a dithering block that is used when performing dithering of the first region for a predetermined value or less.

If an average grayscale level of the video data is lower than a predetermined value, the processor may control the driving of the ditherer to lower a dithering value of a dithering block that is used when performing dithering of the video data for a predetermined value or less.

The display device according to the aspect of the present disclosure may further include a storage configured to match and store the dithering value of the dithering block in accordance with a change of the grayscale level, wherein the processor controls the ditherer to perform the dithering in accordance with the dithering value that matches the grayscale level.

The storage may store a table in which the grayscale level and dithering value of the dithering block are matched such that the dithering value of the dithering block is lowered as the grayscale level is lowered, and the processor may control the ditherer to perform the dithering using the stored table.

If the sensed illumination is equal to or higher than the predetermined value, the processor may control the ditherer to perform the dithering using a dithering value of a dithering block as it is regardless of the grayscale level of the video data.

According to another aspect of the present disclosure, a method for controlling a display device includes sensing illumination around the display device; and controlling driving of a ditherer that performs dithering of video data being displayed on the basis of a grayscale level of the video data if the sensed illumination is lower than a predetermined value.

The controlling the driving of the ditherer may turn off driving of a dithering block that is used when the ditherer performs dithering of a first region if there exists the first region in which the grayscale level of the video data is lower than a predetermined value.

The controlling the driving of the ditherer may turn off the driving of the ditherer if an average grayscale level of the video data is lower than a predetermined value.

The controlling the driving of the ditherer may lower a dithering value of a dithering block that is used when the ditherer performs dithering of a first region for a predetermined value or less if there exists the first region in which the grayscale level of the video data is lower than a predetermined value.

The controlling the driving of the ditherer may lower a dithering value of a dithering block that is used when the ditherer performs the dithering for a predetermined value or less if an average grayscale level of the video data is lower than a predetermined value.

The controlling the driving of the ditherer may perform the dithering in accordance with a dithering value that matches the grayscale level among dithering values of the dithering block that are matched with the grayscale level and pre-stored in accordance with a change of the grayscale level.

The controlling the driving of the ditherer may perform the dithering using a pre-stored table that is matched to lower the dithering value of the dithering block in accordance with lowering of the grayscale level.

The controlling the driving of the ditherer may perform the dithering using a dithering value of a dithering block as it is regardless of the grayscale level of the video data if the sensed illumination is equal to or higher than the predetermined value.

According to the various embodiments of the present disclosure, since noise can be minimized even on a low-grayscale region of an image being displayed, user's convenience is improved.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor (not shown).

Figure 1:
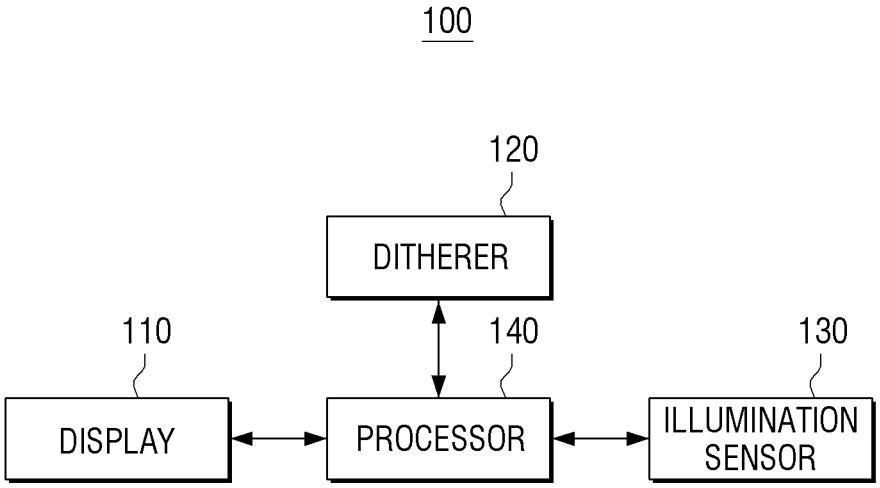
Figure 2:
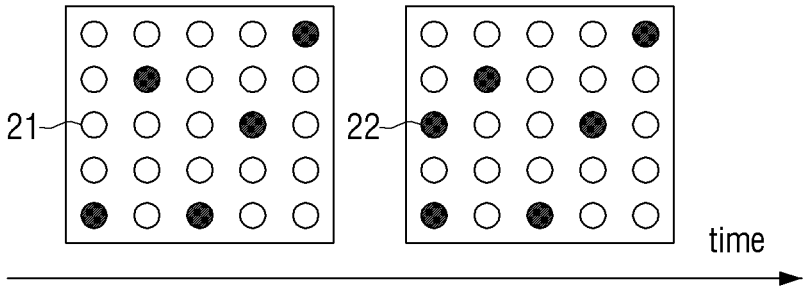
Figure 4:
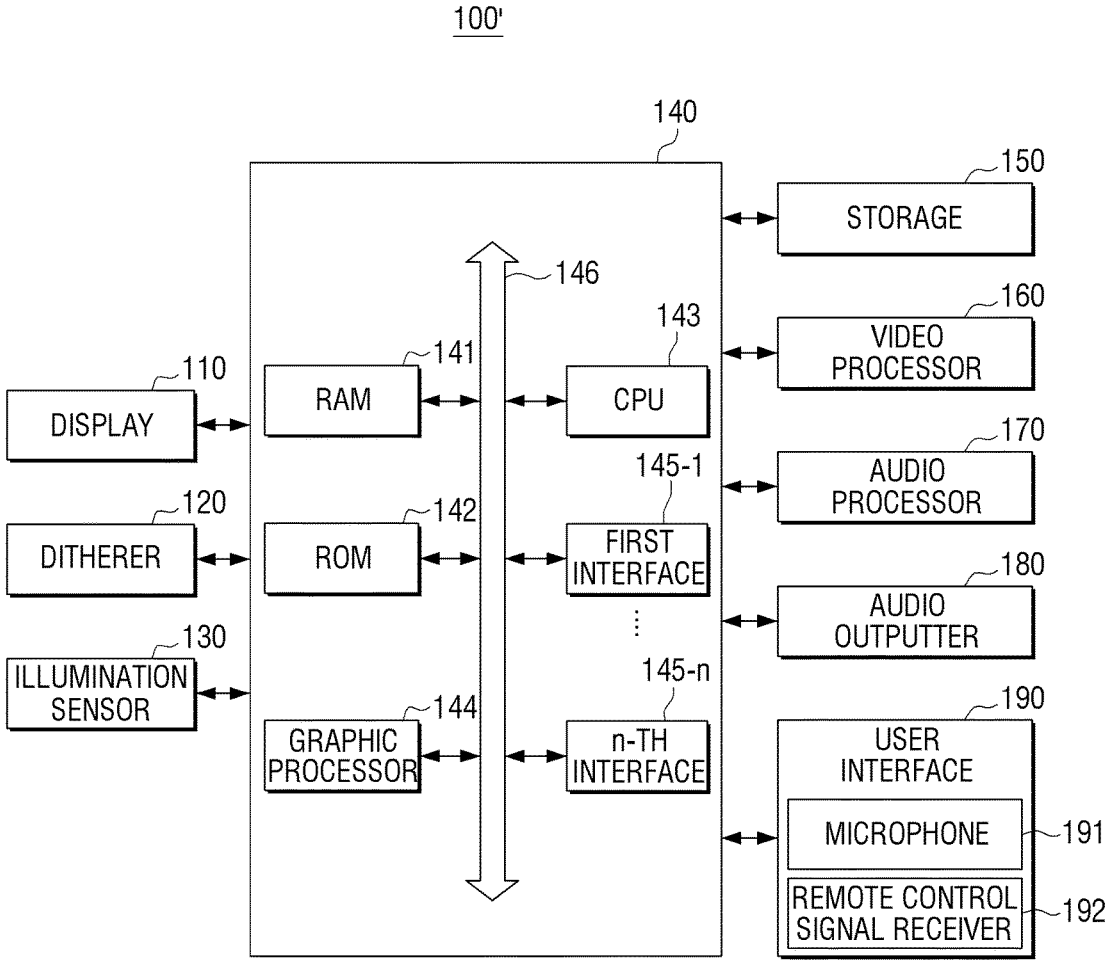
Figure 5:
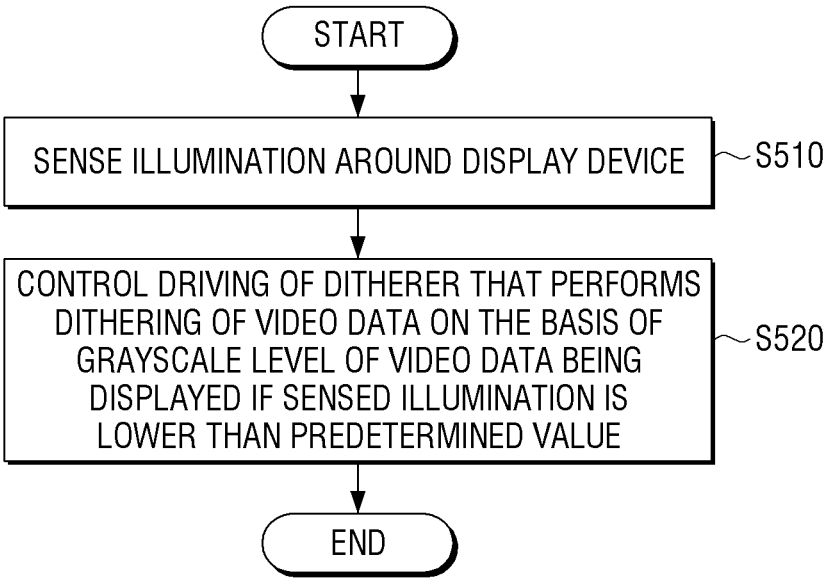

The above and/or other aspects of the present disclosure will be more apparent by describing certain exemplary embodiments of the present disclosure with reference to the accompanying drawings, in which:

FIG. 1 is a block diagram schematically illustrating the configuration of a display device according to an exemplary embodiment of the present disclosure;

FIG. 2 is a diagram explaining noise occurrence in accordance with a luminance difference according to an exemplary embodiment of the present disclosure;

FIG. 3, including (a)-(d), is a diagram explaining a method for controlling dithering using a dithering block according to an exemplary embodiment of the present disclosure;

FIG. 4 is a block diagram illustrating the detailed configuration of a display device according to another exemplary embodiment of the present disclosure; and FIG. 5 is a flowchart explaining a method for controlling a display device according to an exemplary embodiment of the present disclosure.

DETAILED DESCRIPTION

Reference will now be made in detail to the embodiments, examples of which are illustrated in the accompanying drawings, wherein like reference numerals refer to the like elements throughout. The embodiments are described below by referring to the figures.

Hereinafter, embodiments of the present disclosure will be described in detail with reference to the accompanying drawings.

FIG. 1 is a block diagram schematically illustrating the configuration of a display device according to an exemplary embodiment of the present disclosure.

Referring to FIG. 1, a display device 100 according to an embodiment of the present disclosure includes a display 110, a ditherer 120, an illumination sensor 130, and a processor 140.

The display 110 is configured to display an image on the basis of a video signal that is processed by the processor 140. The display 110 includes a display panel (not illustrated) and an LED backlight unit (not illustrated). The LED backlight unit irradiates the display panel with white light, and includes a plurality of light sources. Here, the plurality of light sources are composed of LEDs (Light Emitting Diodes), and are connected to each other on a PCB (Printed Circuit Board).

The LED backlight unit may include an LED module and an LED driving element. The LED module may irradiate the display panel with backlight in accordance with a driving voltage that is applied from the LED driving element. Here, the luminance of the LED module may be determined in accordance with an average value of current that flows to the LED module.

The LED driving element is configured to supply a power to the LED module, and may supply a driving voltage to the LED module on the basis of a dimming signal for driving the LED module and the current that flows to the LED module. Here, the dimming signal may mean a signal for controlling luminance and color temperature of the LED or for temperature compensation.

On the other hand, the display 110 may be implemented using OLEDs (Organic Light Emitting Diodes). In this case, since the display 110 is self-luminous through fluorescent organic compounds, it may not include the LED backlight unit.

The ditherer 120 performs dithering of a video signal that is input from an outside, and generates a video signal in the unit of specific bits. Here, the "video signal in the unit of specific bits" means that the bit number of respective color signals (R, G, and B signals) for one pixel that constitutes the video signal corresponds to a specific number of bits. The dithering that is performed by the ditherer 120 is performed in accordance with temporal/spatial dithering techniques using a dithering mask.

The ditherer 120 does not perform dithering of the whole video signal. Preferably, if or when the bit unit of the video signal exceeds the specific bit unit, the ditherer 120 performs dithering of the video signal using the dithering mask, whereas if or when the bit unit of the video signal is the specific bit unit, the ditherer 120 does not perform dithering of the video signal. For example, if it is assumed that the display device 100 displays an image that is expressed as a video signal in a unit of 8 bits, the ditherer 120 may perform the dithering if the input video signal is in a unit of 10 bits, and the ditherer 120 may not perform the dithering if the input video signal is in the unit of 8 bits.

The illumination sensor 130 is configured to measure an illumination value around the display device 100. At least one illumination sensor 130 may be installed on the inside or outside of the display device 100 to sense the illumination in real time, and when the illumination is sensed, the illumination sensor 130 may transmit sensed data to the processor 140.

The processor 140 is configured to control the whole operation of the display device 100. If or when the illumination that is sensed by the illumination sensor 130 is lower than a predetermined value, the processor 140 may control the driving of the ditherer 120 on the basis of a grayscale level of the video data.

Specifically, the processor 140 may compare the illumination value that is measured by the illumination sensor 130 with a predetermined reference illumination value, and may determine whether a space in which the display device 100 is located is a dark room or a bright room in accordance with the result of the comparison. That is, if the sensed illumination is lower than the predetermined value, the processor 140 may determine that the space in which the display device 100 is located is a dark room with little or no light, whereas if the sensed illumination is equal to or higher than the predetermined value, the processor 140 may determine that the space in which the display device 100 is located is a bright room. In this case, the predetermined reference illumination value for determining whether the space is a dark room or a bright room may be pre-stored in the storage 150. The configuration of the storage 150 will be described later with reference to FIG. 4.

If or when it is determined that the space is a dark room, the processor 140 may control the driving of the ditherer 120 on the basis of the grayscale level of the video data. The grayscale level of the video data may be classified into grayscale levels of 0 to 256, and the processor 140 may detect the grayscale level of the video data. For example, if it is determined that the detected grayscale level is equal to or lower than a predetermined level, the processor 140 may turn off the ditherer 120 through control of the driving of the ditherer 120, so that the ditherer 120 does not perform the dithering. For example, if the detected grayscale level is equal to or lower than the grayscale level of 32, the processor 140 may turn off the ditherer 120. Further, the processor 140 may control the ditherer 120 to lower a dithering value of a dithering block, which is used when the ditherer 120 performs the dithering, for a predetermined value or less.

If or when the illumination around the display device 100 is low (i.e., dark), that is, if the display device 100 is located in a dark room, noise may occur when the dithering is performed with respect to a low-grayscale region of an image being displayed. The processor 140 may reduce the noise through control of the driving of the ditherer 120 on the basis of the sensed illumination. The occurrence noise in the low-grayscale region of the image in the dark room will be described with reference to FIG. 2.

FIG. 2 is a diagram explaining noise occurrence in accordance with a luminance difference according to an exemplary embodiment of the present disclosure. As illustrated in FIG. 2, in the case where dithering of a low-grayscale pixel region 21 of an image is performed in a dark room, noise occurs due to a difference in luminance between frames of the pixel region 21 and a region 22 of which the dithering has been performed. That is, in the case where the luminance difference between surrounding pixels in one video frame exceeds a just noticeable difference (JND), visible noise occurs in accordance with the change of frames.

In an embodiment, the processor 140 may detect if or when there exists a first region in which the grayscale level of the video data is lower than a predetermined value, and if the first region is detected, the processor 140 may partially turn off the driving of a dithering block that is used when the ditherer 120 performs dithering of the first region. Specifically, the processor 140 may partially perform the dithering as the ditherer 120 intercepts only a driving voltage that is applied to the dithering block for the first region through a dithering mask that is applied to one video frame constituting the video data.

Further, in another embodiment that is different from the above-described embodiment, the processor 140 may calculate an average grayscale level of the video data, and if the calculated average grayscale level is lower than a predetermined value, the processor 140 may turn off the whole or entire driving of the ditherer 120. Specifically, the processor 140 may not perform the dithering as the ditherer 120 intercepts the driving voltage that is applied to the whole dithering mask that is applied to one video frame constituting the video data.

Further, as still another embodiment that is different from the above-described embodiment, the processor 140 may detect if there exists a first region in which the grayscale level of the video data is lower than a predetermined value, and if the first region is detected, the processor 140 may control the driving of the ditherer 120 to lower the dithering value of the dithering block that is used when the ditherer 120 performs dithering of the first region for a predetermined value or less. For example, the processor 140 controls the driving of the ditherer 120 to perform the dithering with respect to one video frame that constitutes the video data using the dithering block having a relatively small grayscale value during conversion of 10-bit and 8-bit quantization bit formats. In this case, although the dithering is performed, the strength of the dithering is low, and thus the noise occurring due to the luminance difference can be reduced. This will be described with reference to FIG. 3.

FIG. 3 is a diagram explaining a method for controlling dithering using a dithering block according to an exemplary embodiment of the present disclosure. As illustrated in FIG. 3, a dithering block in which a low strength is set is illustrated in (a) of FIG. 3. That is, in the case where the level of a low-grayscale region is very low in a dark room, dithering is performed using the dithering block having a relatively small grayscale value. A dithering block in which the strength that is somewhat higher than the strength as illustrated in (a) of FIG. 3 is set is illustrated in (b) of FIG.

3. In this case, the level of the low-grayscale region is set to be higher than that as illustrated in (a) of FIG. 3. A dithering block in which the strength that is higher than the strength as illustrated in (b) of FIG. 3 is set is illustrated in (c) of FIG. 3. In this case, the level of the low-grayscale region is set to be higher than that as illustrated in (b) of FIG. 3. On the other hand, a dithering block having the grayscale value of 0 is illustrated in (d) of FIG. 3. In this case, power supply to the corresponding dithering block is intercepted, and thus dithering is not performed.

Further, as another embodiment that is different from the above-described embodiment, the processor 140 may calculate an average grayscale level of the video data, and if the calculated average grayscale level is lower than a predetermined value, the processor 140 may control the driving of the ditherer 120 to lower the dithering value of the dithering block that is used when performing dithering of the video data for a predetermined value or less. That is, the processor 140 may control the driving of the ditherer 120 so that a dithering mask that is applied to the whole of one video frame constituting the video data has a relatively small grayscale value.

FIG. 4 is a block diagram illustrating the detailed configuration of a display device according to another exemplary embodiment of the present disclosure.

As illustrated in FIG. 4, a display device 100' according to another embodiment of the present disclosure includes a display 110, a ditherer 120, an illumination sensor 130, a processor 140, storage 150, a video processor 160, an audio processor 170, an audio outputter 180, and a user interface 190. Hereinafter, explanation of the duplicate configuration as illustrated in FIG. 1 will be omitted.

The storage 150 is configured to match and store the dithering value of the dithering block in accordance with the change of the grayscale level. In particular, the storage 150 may store a table in which the grayscale level and dithering value of the dithering block are matched such that the dithering value of the dithering block is lowered as the grayscale level is lowered.

On the other hand, the storage 150 may store various modules for driving the display device 100'.

Specifically, the storage 150 may store a base module that processes signals that are transferred from respective pieces of hardware included in the display device 100', a storage module that manages a database (DB) or registries, a security module, and a communication module.

The video processor 160 is configured to perform various video processes, such as decoding of an input image, scaling, noise filtering, frame rate conversion, and resolution conversion.

The audio processor 170 is configured to process audio data.

The audio outputter 180 is configured to output audio data that is processed by the audio processor 170.

The user interface 190 is configured to sense a user interaction for controlling the whole operation of the display device 100'. In particular, the user interface 190 may include a camera (not illustrated), a microphone 191, and a remote control signal receiver 192.

The processor 140 may control the whole operation of the display device 100' using various kinds of modules stored in the storage 150.

As illustrated in FIG. 4, the processor 140 may include a RAM 141, a ROM 142, a CPU 143, a graphic processor 144, and first to n-th interfaces 145-1 to 145-n, which may be connected to one another via a bus 146.

In the ROM 142, a set of commands for system booting is stored. The CPU 143 copies various kinds of application programs stored in the storage 150 to the RAM 141, and executes the application programs copied to the RAM 141 to perform various kinds of operations.

The graphic processor 144 generates a screen that includes various objects, such as icons, images, and texts, using an operator (not illustrated) and a renderer (not illustrated). The operator operates attribute values, such as coordinate values, shapes, sizes, and colors of the objects to be displayed in accordance with the layout of the screen. The renderer generates a screen of various layouts including the objects on the basis of the attribute values operated by the operator.

The CPU 143 accesses the storage 150 and performs booting using the OS stored in the storage 150. Further, the CPU 143 performs various operations using various kinds of programs, content, and data stored in the storage 150.

The first to n-th interfaces 145-1 to 145-n are connected to the various kinds of constituent elements as described above. One of the first to n-th interfaces may become a network interface that is connected to an external device through a network.

FIG. 5 is a flowchart explaining a method for controlling a display device according to an exemplary embodiment of the present disclosure.

First, illumination around the display device 100 is sensed (S510).

Thereafter, if or when the sensed illumination is lower than a predetermined value, driving of a ditherer 120 that performs dithering of video data being displayed is controlled on the basis of or responsive to a grayscale level of the video data (S520).

In this case, if or when there exists a first region in which the grayscale level of the video data is lower than a predetermined value, driving of a dithering block that is used when the ditherer 120 performs dithering of the first region may be turned off.

Further, if or when an average grayscale level of the video data is lower than a predetermined value, the driving of the ditherer 120 may be turned off.

Further, if or when there exists the first region in which the grayscale level of the video data is lower than a predetermined value, the ditherer 120 may lower or reduce a dithering value of the dithering block that is used when the ditherer 120 performs dithering of the first region for a predetermined value or less.

Further, if or when the average grayscale level of the video data is lower than the predetermined value, the dithering value of the dithering block that is used when the ditherer 120 performs the dithering of the first region may be lowered or reduced for a predetermined value or less.

Further, the dithering may be performed in accordance with the dithering value that matches or is correlated to the grayscale level of the video data among the dithering values of the dithering block that are matched or correlated and pre-stored in accordance with a change of the grayscale level. Here, the dithering may be performed using a pre-stored table in which the grayscale level and dithering value of the dithering block are matched or correlated such that the dithering value of the dithering block is lowered or reduced as the grayscale level is lowered.

On the other hand, if or when the sensed illumination is equal to or higher than the predetermined value, the dithering is performed using the dithering value of the dithering block as is regardless of the grayscale level of the video data.

According to the various embodiments of the present disclosure as described above, the noise of the image can be adaptively minimized in accordance with brightness around the display device, and thus the problem of image quality deterioration can be solved.

The method for controlling a display device according to various embodiments as described above may be implemented by a program and may be stored in various recording media. That is, a computer program that can be processed by various kinds of processors to execute various control methods as described above may be stored in a recording medium to be used.

As an example, a non-transitory computer readable medium may be provided to store therein a program that includes sensing illumination around the display device, and controlling driving of a ditherer that performs dithering of video data being displayed on the basis of a grayscale level of the video data if or when the sensed illumination is lower than a predetermined value.

A non-transitory computer readable medium is not a medium that stores data for a short period, such as a register, a cache, or a memory, but means a medium which semi-permanently stores data and is readable by a device. Specifically, the above-described programs may be stored and provided in the non-transitory computer readable medium, such as, a CD, a DVD, a hard disc, a Blu-ray disc, a USB, a memory card, and a ROM.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

Although a few embodiments have been shown and described, it would be appreciated by those skilled in the art that changes may be made in these embodiments without departing from the principles and spirit thereof, the scope of which is defined in the claims and their equivalents.

What is claimed is:

1. A display device, comprising:

a display comprising a plurality of Light Emitting Diodes (LEDs);

an illumination sensor configured to sense illumination around the display device; and a processor configured to, based on an image being received, control the display to display the image by performing dithering based on the sensed illumination around the display device and a grayscale level of the image, wherein the processor is configured to:

based on the sensed illumination around the display device being lower than a predetermined value, identify at least one area with a grayscale level being lower than a predetermined level from among a plurality of areas of the image, control the display to display the image using at least one LED corresponding to the identified area without performing the dithering, and control the display to display the image by performing the dithering using remaining LED among the plurality of LEDs.

2. The display device as claimed in claim 1, wherein the processor is configured to, based on a grayscale level corresponding to a first area of the image being lower than the predetermined level, turn off voltage for a dithering block corresponding to the first area of the image.

3. The display device as claimed in claim 1, wherein the processor is configured to, based on an average grayscale level of the image being lower than the predetermined level, turn off voltage for each of a plurality of dithering blocks corresponding to the plurality of areas of the image.

4. The display device as claimed in claim 1, wherein the processor is configured to, based on a grayscale level corresponding to a first area of the image being lower than the predetermined level, reduce a dithering value of a dithering block corresponding to the first area of the image for a predetermined value or less.

5. The display device as claimed in claim 4, further comprising a storage configured to correlate and store the dithering value in accordance with a change of the grayscale level, wherein the processor is configured to perform the dithering in accordance with the dithering value correlated with the grayscale level.

6. The display device as claimed in claim 1, wherein the processor is configured to, based on an average grayscale level of the image being lower than the predetermined level, reduce a dithering value of each of a plurality of dithering blocks corresponding to the plurality of areas of the image for a predetermined value or less.

7. The display device as claimed in claim 6, further comprising a storage configured to correlate and store the dithering value in accordance with a change of the grayscale level, wherein the processor is configured to perform the dithering in accordance with the dithering value correlated with the grayscale level.

8. The display device as claimed in claim 7, wherein the storage is configured to store a table in which the grayscale level and the dithering value are correlated where the dithering value is reduced as the grayscale level is reduced, and wherein the processor is configured to perform the dithering using the table.

9. The display device as claimed in claim 1, wherein the processor is configured to, based on the sensed illumination being equal to or higher than the predetermined value, perform the dithering using a dithering value of each of a plurality of dithering blocks corresponding to the plurality of areas of the image.

10. A method for controlling a display device, comprising:

sensing illumination around the display device comprising a plurality of Light Emitting Diodes (LEDs);

based on the sensed illumination around the display device being lower than a predetermined value, identify at least one area with a grayscale level being lower than a predetermined level from among a plurality of areas of an image;

displaying the image using at least one LED corresponding to the identified area without performing dithering; and displaying the image by performing the dithering using remaining LED among the plurality of LEDs.

11. The method as claimed in claim 10, wherein the performing dithering comprises, based on a grayscale level corresponding to a first area being lower than the predetermined level, turning off voltage for a dithering block corresponding to the first area of the image.

12. The method as claimed in claim 10, wherein the performing dithering comprises, based on an average grayscale being lower than the predetermined level, turning off voltage for each of a plurality of dithering blocks corresponding to the plurality of areas of the image.

13. The method as claimed in claim 10, wherein the performing dithering comprises, based on a grayscale level corresponding to a first area being lower than the predetermined level, reducing a dithering value of a dithering block corresponding to the first area of the image.

14. The method as claimed in claim 13, wherein the performing dithering comprises performing the dithering in accordance with a dithering value correlated with the grayscale level among dithering values correlated with the grayscale level and pre-stored in accordance with a change of the grayscale level.

15. The method as claimed in claim 14, wherein the performing dithering comprises performing the dithering using a pre-stored table correlated to lower the dithering value in accordance with lowering of the grayscale level.

16. The method as claimed in claim 10, wherein the performing dithering comprises, based on an average grayscale level being lower than the predetermined level, reducing a dithering value of each of a plurality of dithering blocks corresponding to the plurality of areas of the image.

17. The method as claimed in claim 16, wherein the performing dithering comprises performing the dithering in accordance with the dithering value correlated with the grayscale level among dithering values correlated with the grayscale level and pre-stored in accordance with a change of the grayscale level.

18. The method as claimed in claim 17, wherein the performing dithering comprises performing the dithering using a pre-stored table correlated to reduce the dithering value in accordance with reduction of the grayscale level.

19. The method as claimed in claim 10, wherein the performing dithering comprises performing the dithering using a dithering value of each of a plurality of dithering blocks corresponding to the plurality of areas of the image based on the sensed illumination being equal to or higher than the predetermined value.

20. A non-transitory computer readable storage storing a method for controlling a display device, the method comprising:

sensing illumination around the display device comprising a plurality of Light Emitting Diodes (LEDs);

based on the sensed illumination around the display device being lower than a predetermined value, identify at least one area with a grayscale level being lower than a predetermined level from among a plurality of areas of an image;

displaying the image using at least one LED corresponding to the identified area without performing dithering; and displaying the image by performing the dithering using remaining LED among the plurality of LEDs.

* * * * *